United States Patent [19]

Robinson et al.

[11] 4,102,155

[45] Jul. 25, 1978

[54] KNITTING METHOD

[75] Inventors: Frank Robinson; Nigel Stephen Whatmough, both of Breaston, England

[73] Assignee: Courtaulds Limited, London, England

[21] Appl. No.: 787,024

[22] Filed: Apr. 13, 1977

[30] Foreign Application Priority Data

Apr. 14, 1976 [GB] United Kingdom ..... 15223/76

[51] Int. Cl.[2] ..... A41B 9/02

[52] U.S. Cl. ..... 66/176

[58] Field of Search ..... 66/176, 175, 171, 170

[56] References Cited

U.S. PATENT DOCUMENTS

| | | | |
|---|---|---|---|
| 3,057,178 | 10/1962 | Konklin | 66/170 |
| 3,635,051 | 1/1972 | Betts et al. | 66/176 |
| 3,882,697 | 5/1975 | Betts et al. | 66/176 |

FOREIGN PATENT DOCUMENTS

| | | | |
|---|---|---|---|
| 1,494,335 | 7/1967 | France | 66/176 |
| 452,770 | 5/1968 | Switzerland | 66/176 |

*Primary Examiner*—Ronald Feldbaum

*Attorney, Agent, or Firm*—Davis, Hoxie, Faithfull & Hapgood

[57] ABSTRACT

A method of knitting a blank for a sleeved garment includes the steps, in either order, of knitting a piece of fabric constituting the body of the garment having front and rear body parts with wales extending in the direction from the waist to the neck of the garment, and knitting another piece of fabric comprising sleeves for the garment with courses extending in the length direction of the sleeves, and also comprising a shoulder region of the garment located between the two sleeves with courses continuous between the sleeves and the shoulder region, the latter being knitted as an extension of the body of the garment with wales continuous between the body and the shoulder region.

Various methods of knitting the blank are described which result in the sleeves, in the finished garment, either being disposed at right angles to the body or being downwardly inclined from the shoulder region, and which give various styles of the border lines dividing the sleeves from the shoulder region.

24 Claims, 9 Drawing Figures

KNITTING METHOD

This invention relates to the production of knitted garments and is concerned with a method of knitting blanks for garments having sleeves, with the production of garments from the blanks, and with the garments thus produced.

It is an advantage of the method that it produces garment blanks in one piece comprising all the main parts of the garment. To produce a garment from one of the garment blanks merely requires that some free edges of the blank should be seamed to one another and that some final finishing such as trimming of the neck and attachment of fastenings should be carried out.

According to one aspect of the invention, a method of knitting a blank for a sleeved garment comprises the steps, in either order, of knitting a piece of fabric constituting the body of the garment having front and rear body parts with wales extending in the direction from waist to neck of the garment blank, and knitting another piece of fabric comprising sleeves for the garment with courses extending in the length direction of the sleeves, and also comprising a shoulder region of the garment located between the two sleeves with courses continuous between the sleeves and said shoulder region, said shoulder region being knitted as an extension of the body of the garment with wales continuous between the body and shoulder region.

The method can be carried out on a knitting machine having needles arranged in a single needle bed or in two opposed needle beds, that is the blanks can be knitted in single jersey or in double jersey fabric. The knitting machine used must have the capability of knitting on some needles of the machine whilst adjacent needles remain inactive but retain in their hooks knitted loops of the blank. The knitting machine must also have the capability of starting up knitting on bare needles. A preferred machine for carrying out the present method is the V-flat knitting machine JDR manufactured by Edouard Dubied & Cie of Neuchatel, Switzerland and fitted with a PM (presser foot) attachment.

The said shoulder region may comprise a number of courses equal to the maximum number of courses in the sleeves. The body of the garment may comprise a front or rear panel having two further panels integral with it and located one on each side of it or it may comprise a front or rear panel having a single further panel with it and located at one side of it. The said two further panels will together constitute the rear or front of the body. Only the first mentioned front or rear panel has knitted wales continuous with wales of said shoulder region of the garment.

Alternatively, said shoulder region may comprise a smaller number of courses than the sleeves, for example half the number, a front or rear panel of the body of the garment having wales continuous with wales of said shoulder region and a panel or panels constituting the rear or front of the garment body having an extension or extensions constituting a further shoulder region of the garment. Said further shoulder region may be shaped to correspond with shaped sleeves of the blank so that when joined to the sleeves in the finished garment, the joins lie along Raglan style lines. Alternatively, said further shoulder region may be shaped to correspond with shaped sleeves of the blank so that when joined to the sleeves in the finished garment, the joins lie along style lines of a set-in style.

When said shoulder region has a smaller number of courses than the sleeves, it may be knitted contemporaneously with part of the fabric constituting the sleeves so that the course of the shoulder region most remote from the garment body in the blank is continuous with sleeve courses lying along the upper edges of the sleeves in the finished garment and located centrally in the sleeves along a line about which the sleeves are folded to form the garment. The course of the shoulder region most remote from the body in the blank may also be continuous with sleeve courses lying along the upper edges of the sleeves in the finished garment but located along free edges of the sleeves in the blank.

The said shoulder region may have a number of courses greater than half the number of courses in the sleeves but less than the full number and may be shaped to correspond with shaped sleeves so that when joined to the sleeves in the finished garment, the joins lie along style lines of a saddle shoulder style.

The sleeves may be caused to assume a downward inclination in relation to the body by forming apertures on the border lines dividing the sleeves from said shoulder region said apertures extending into the fabric of the sleeve and/or shoulder region from edges thereof.

The fabric comprising the sleeves and said shoulder region may be shaped so that it contains a pouch causing the sleeves to incline downwardly in relation to the body in the finished garment. The pouch is formed by knitting courses of the fabric of different length so that wales thereof in the central area of the shoulder region are longer than in areas of the fabric to each side of the central area, that is, towards the ends of the sleeves.

According to a further aspect of the invention, a blank for a sleeved garment comprises a piece of fabric constituting the body of the garment and having front and rear body parts with wales extending in the direction from waist to neck of the garment blank, and another piece of fabric comprising sleeves for the garment with courses extending in the length direction of the sleeves, said other piece of fabric also comprising a shoulder region of the garment located between the two sleeves and with wales continuous between the sleeves and said shoulder region and said shoulder region constituting an extension of the body of the garment with wales which are continuous between the body and said shoulder region.

The invention will be further described, by way of example, with reference to FIGS. 1 to 9 of the accompanying drawings, each of which illustrates a garment blank knitted by the method of the invention. Like reference numerals are used to indicate like parts in the different Figures.

A feature of the knitting methods to be described is that they produce garments with fashioning or shaping at the front but not at the back thus utilising the flexibility of knitted fabric to achieve the required fit at the back.

Figure 1:
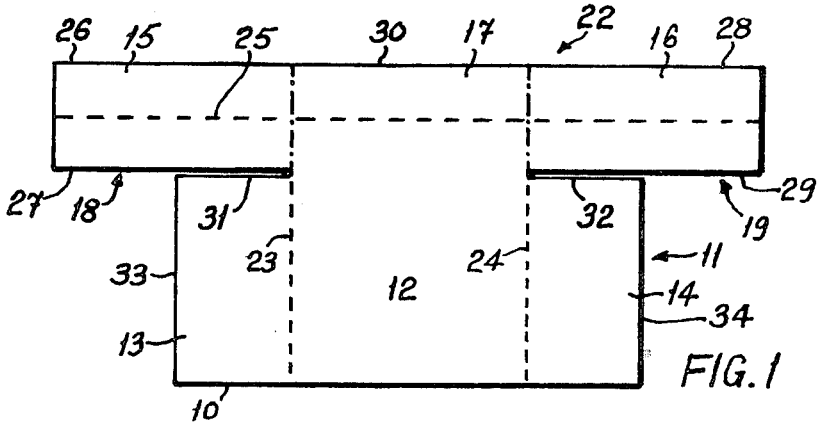
FIG. 1 is a schematic view of a garment blank showing a first mode of practicing the invention.

FIG. 1 illustrates the knitting of a garment according to the invention. In knitting this garment the body or the sleeves of the garment may be knitted first. For example, knitting may be begun at the waist 10 of the body and continued in an upward direction in the Figure so that the body 11 of the garment is knitted as one piece of fabric with wales extending in the direction from the waist 10 towards the neck of the garment. The body fabric comprises a back part 12 and two front parts 13 and 14. When the body fabric is completed, needles holding loops of the front body parts 13 and 14 are operated to cast off their loops whereas needles holding loops of the back part 12 are caused to retain their loops and knitting of the sleeves 15 and 16 of the garment is then carried out. The sleeves are knitted as one piece of fabric with courses extending in the length direction of the sleeves. A shoulder region 17 of the garment body also forms part of the same piece of fabric as the sleeves and is knitted at the same time as the sleeves, the courses of the sleeves extending along each sleeve and through the shoulder region 17 located between the sleeves. When starting knitting of the sleeves 15 and 16 and shoulder region 17, the bare needles originally holding the cast-off loops of the front body parts 13 and 14 are brought back into action to knit together with additional needles, which form stitches in the regions 18 and 19 of the sleeves 15 and 16, as well as needles still holding loops of the back body part 12. Thus, the one piece of fabric 22 constituting the sleeves 15 and 16 and body shoulder region 17 is knitted as an extension of and integral with the body fabric 11 so that knitted wales are continuous between the body 11 and the shoulder region 17 which comprises a number of courses equal to the number of courses in the sleeves. In FIG. 1, chain dotted lines separate the sleeves 15 and 16 and the shoulder region 17. When the fabric 22 is complete, the blank is cast off the needles of the knitting machine and knitting of another blank can be commenced.

To make a garment from the blank it is folded along lines 23 and 24 (shown broken) to lay the front body parts 13 and 14 on top of the back body part 12. The fabric 22 is also folded along the line 25 (shown broken) to bring edges 26, 27 and 28, 29 of the sleeves adjacent one another for seaming together. The edge 30 is also brought adjacent upper edges 31 and 32 of the body parts 13 and 14 and is seamed thereto. Seaming of the parts 13 and 14 together along the edges 33 and 34 substantially completes the garment in a T-shirt style with a closed front. A neck opening (not shown) of desired shape is cut into the shoulder region 17 and a trimming is secured round the edge of the opening.

The seams needed to complete the garment from the blank may be formed in an order different from that described. If desired, a jacket may be formed by providing fastenings for the edges 33 and 34 instead of seaming them together.

Instead of bringing all the needles required for knitting the sleeves into action at once, the needles may be brought into action progressively starting first with needles near the shoulder region 17 so that shaped sleeves tapering towards the cuffs are produced. When completing the sleeves the needles will be taken out of action progressively in the reverse order to that in which they were brought into action. When the sleeves are shaped in this way, some parts of the sleeves contain fewer courses than the widest parts of the sleeves near the body of the garment. The shoulder region 17, however, comprises a number of courses equal to the maximum number of courses in the sleeves.

Figure 2:
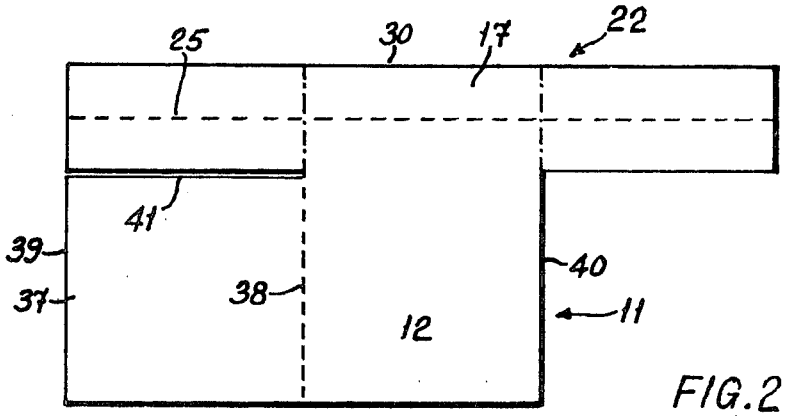
FIG. 2 is a schematic view of a garment blank illustrating a second mode of practicing the invention.

In FIG. 2 is illustrated a garment blank which is knitted in a similar manner to that of FIG. 1. However, in this case the front of the body of the garment is constituted by a single body part 37. The part 37 is laid on top of the back body part 12 by folding along the lines 38, after the garment blank has been removed from the knitting machine. The edge 38 is then seamed to the edge 40 and the edge 30 to the edge 41. The sleeves are seamed longitudinally as in the garment blank of FIG. 1. They may be shaped.

As in the garment of FIG. 1, the sleeves may be knitted before the body if desired. The courses of the sleeves run longitudinally of the sleeves and the wales of the body extend in the waist-neck direction, the wales being continuous between the body 11 and the shoulder region 17.

Figure 3:
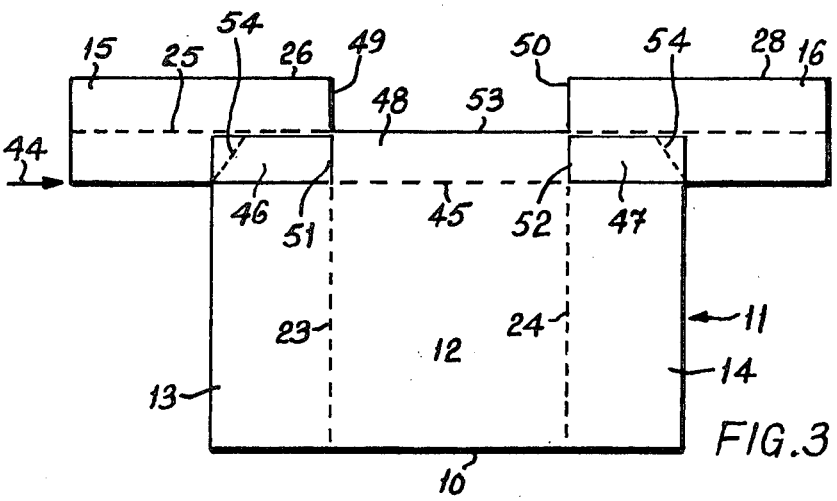
FIG. 3 is a schematic view of a garment blank illustrating a third mode of practicing the invention as applied to a set-on sleeve style garment.

In FIG. 3 is illustrated a garment blank for a set-on sleeve style of garment. When a start is made at the waist 10, knitting is carried on to the arm pit level 44 in the garment and the needles holding loops of the back part 12 of the body 11 of the garment along the line 45 are then taken out of action whilst still holding their loops. Knitting is continued to form areas of fabric constituting the shoulder regions 46 and 47 of front parts 13 and 14 of the body of the blank. The areas 46 and 47 are shown in dotted lines in the Figure. When the areas 46 and 47 are completed, the needles holding loops of these areas are operated to cast off their loops and knitting of the sleeves 15 and 16 and a shoulder region 48 of the back of the garment body is then begun. When the edge 53 is reached in the region 48 (at the level of the eventual fold line 25 of the sleeves 15 and 16), knitting of this region is stopped. The needles holding loops of the region 48 may, at this juncture, be taken out of action whilst still holding their loops and later operated to cast off or they may be operated at once to cast off their loops.

Knitting of the sleeves 15 and 16 continues until the edges 26 and 28 are reached and the blank is cast off the needles.

To make a garment from the blank, the front body parts 13 and 14 are laid over the back body part 12, folding the blank along lines 23 and 24. The sleeves are then folded along line 25 and edges 49 and 50 are seamed to edges 51 and 52 respectively. The sleeves are seamed as in the example of FIG. 1. The neck opening must be cut out and trimmed and front fastenings added to complete a jacket.

The body shoulder region 48 located between the two sleeves 15 and 16 and knitted in one piece with them is also integral with and constitutes an extension of the body 11 of the garment having wales continuous with wales of the back part 12 of the body.

In order to economise on the quantity of yarn used to knit the garment, the neck opening of the garment shown in FIG. 3 can be partly formed on the knitting machine. This is done by taking needles out of action progressively during knitting of the shoulder regions 46 and 47, starting at the outer edge of each of the front garment parts 13 and 14 and thus shaping these regions along broken lines 54.

Figure 4:
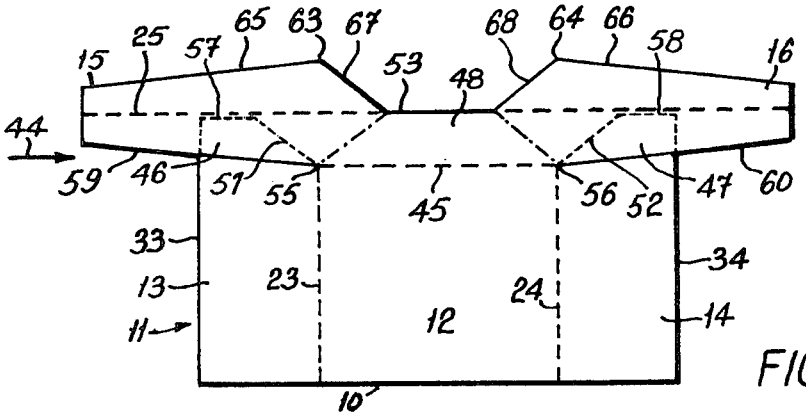
FIG. 4 is a schematic view of a garment blank illustrating a fourth mode of practicing the invention as applied to a raglan style garment.

FIG. 4 illustrates a blank for a raglan style garment. If knitting is begun at the waist 10 of the body 11, it proceeds to the arm pit level 44 where knitting is halted on needles holding loops in the line 45 extending between the two central points 55 and 56 of the arm pits of the blank. These needles are, however, caused to retain their loops which are not cast off.

Knitting is continued to form area of fabric constituting shoulder regions 46 and 46 (shown in dotted lines) of front parts 13 and 14 of the body 11, but during the knitting of these areas needles are progressively taken out of action in opposite outwards directions along the needle beds starting at the needles holding loops at the points 55 and 56. The effect of this progressive reduction in the number of active needles is to shape the regions 46 and 47 along raglan style lines 51 and 52 extending from the centre of each armpit region to the upper shoulder line of the garment. The needles holding loops in the lines 51 and 52 may be operated to cast off their loops as they are taken out of action or they may be operated to retain their loops until the regions 46 and 47 are completed.

When the regions 46 and 47 are completed, the needles holding loops of those regions, that is loops in the lines 57 and 58, and also loops in the lines 51 and 52 if those have not been cast off previously, are operated to cast off their loops. The knitting of the sleeves 15 and 16 and a shoulder region 48 of the back of the garment body is then begun.

The first course of the one piece of fabric constituting the two sleeves 15 and 16 with the shoulder region 48 located between them is only slightly longer than the line 45 but as knitting proceeds, more needles are progressively brought into action in an outwards direction from each of the points 55 and 56 to shape the sleeves along the lines 59 and 60. Since the loops of the regions 46 and 47 have previously been cast off the needles, a start up on bare needles is made as needles are introduced along the line 59 and 60.

When the edge 53 is reached in the region 48 (at the level of the eventual fold line 25 of the sleeves 15 and 16) knitting of the region 48 is stopped, by taking out of action needles holding loops along that line. These needles may be operated to cast off their loops or they may be operated to retain their loops which will then be cast off later in the knitting process.

Knitting of the sleeves 15 and 16 then continues but needles are progressively taken out of action in the inwards directions along the needle beds from the cuffs of the sleeves and in the outwards directions from the points 63 and 64. The sleeves are thus shaped along the lines 65 and 66 and along the raglan style lines 67 and 68.

After completion of the blank and when it has been cast off the knitting machine, the sleeves are folded about the line 25 and the body 11 is folded about line 23 and 24 so that the parts 13 and 14 lie on top of the back part 12 of the body. The edges 59, 65 and 60, 66 of the sleeves are then seamed together as are the edges 51 and 67 and the edges 52 and 68. The desired neck shape is cut out and a trimming seamed around the neck opening (not shown). Any parts of the edges 57 and 58 remaining after the neck opening has been formed require seaming to the edge 53. To complete the garment the edges 33 and 34 are provided with fastening means, for example a zip-fastener or buttons.

Instead of knitting the front of the garment body of FIG. 4 in two pieces to make a jacket or cardigan style garment, the front may be formed in one piece to make a jumper. To do this when starting at the waist, knitting is begun in the same way as in knitting the garment of FIG. 2. However, on reaching the underarm level in the garment, knitting is halted on needles holding loops of the body part 12 (FIG. 2) but these needles are caused to retain their loops. Knitting is continued on needles holding loops of the body part 37 (FIG. 2) to form a shoulder region of the garment integral with the part 37. During knitting of this shoulder region, needles are taken out of action progressively in an inwards direction on the machine starting from needles holding loops at each edge of the part 37. The shoulder region is thus shaped so as to be complementary to the aperture bounded by the style lines 67 and 68 and the edge 53. When the body part 37 (FIG. 2) with the integral shoulder region is folded to lie on top of the body part 12 for making up, the shape of the part 37 corresponds to that of the two parts 13 and 14 of FIG. 4 (when folded to lie on part 12) together with their shoulder regions 46 and 47.

Figure 5:
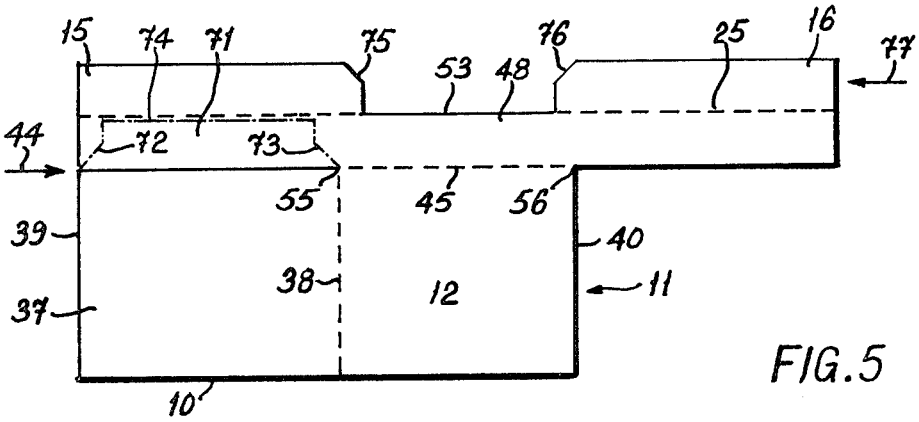
FIG. 5 is a schematic view of a garment blank illustrating a fifth mode of practicing the invention as applied to a set-in sleeve style garment.

FIG. 5 illustrates a blank for a set-in sleeve style garment. Knitting may, as in the case of blanks previously described, begin at the waist or at the other end of the blank. Beginning knitting at the waist 10 of the body 11, one carries on to the arm pit level 44 where knitting is halted on needles holding loops in the line 45 extending between the two central points 55 and 56 of the arm pits of the blank. The needles holding loops in the line 45 retain those loops.

Knitting is continued to form an area of fabric constituting a shoulder region 71 (shown in chain dotted lines) which is an extension of a front part 37 of the body 11. During knitting of the shoulder region 71, needles are first taken progressively out of action inwardly from both ends of the front body part 37 and subsequently knitting is continued on all the remaining needles to shape the region 71 along the lines 72 and 73. When taking needles out of action whilst knitting the region 71, the loops held by those needles may be cast off at once or the loops may be held on the inactive needles and cast off later at a convenient time, for example together with the loops of the final course of the region 71 in the edge 74.

After completion and casting off of the fabric constituting regions 37 and 71, knitting of the sleeves 15 and 16 and a shoulder region 48 of the back of the garment body is begun.

The first course of the one-piece fabric constituting the two sleeves 15 and 16 with the shoulder region 48 located between them extends the whole length of the sleeves and brings back into knitting action the needles holding loops in the line 45 of the rear body part 12. Knitting of the sleeves 15 and 16 is started on bare needles in this course. When the edge 53 is reached in the region 48 (at the level of the eventual fold line 25 of the sleeves 15 and 16) knitting of the region 48 is stopped. The needles holding loops in the edge 53 may be operated at once to cast off their loops or they may retain their loops for casting off later.

Knitting of the sleeves 15 and 16 then continues until the level 77 is reached. Thereafter needles are progressively taken out of action in an outwards direction to shape the sleeves along the lines 75 and 76. After completion of the sleeves the blank is cast off the needles.

To form a garment from the blank, the sleeves are folded about the line 25 (on which the edge 74 and the line 53 lie) and the body 11 is folded about line 38 so that the part 37 lies on top of the body part 12. The shoulder region 71 then lies on top of the shoulder region 48 and the edges 72 and 73 of the region 71 abut the inner edges of the sleeves 15 and 16. The edge 39 is then seamed to the edge 40, the under-edges of the sleeves are seamed together and the inner edges of the sleeves are seamed to the edges 72 and 73. A desired neck shape is cut out, a trimming is seamed around the neck opening (not shown), and any parts of the edges 74 and 53 remaining are seamed to one another to complete the garment.

Figure 6:
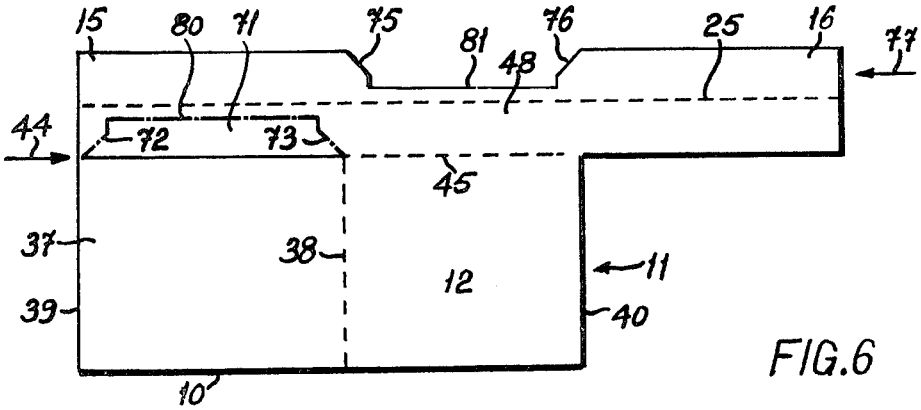
FIG. 6 is a schematic view of a garment blank illustrating a sixth mode of practicing the invention as applied to a saddle shoulder style garment.

The garment blank illustrated in FIG. 6 is shaped to present the appearance of a saddle shoulder style of garment when viewed from the front. The blank is knitted in a generally similar manner to the blank of FIG. 5. Starting at the waist 10 of the body 11, knitting proceeds to the underarm level 44 where needles holding loops in the line 45 are taken out of action but retain their loops, and knitting of a shoulder region 71 in extension of the front part 37 of the body continues, the region 71 being shaped along lines 72 and 73. The region 71 terminates in an edge 80 which is short of the fold line 25.

Knitting of the sleeves 15 and 16 and a body shoulder region 48 follows as in the case of the blank of FIG. 5, the region 48 being located between the two sleeves and constituting an extension of the rear body part 12 so that wales are continuous between the part 12 and the shoulder region 48, whereas courses of knitting extend in the length direction of the sleeves 15 and 16 and are continuous between the two sleeves through the region 48 which forms a single piece of fabric with the sleeves.

Knitting of the region 48 is continued beyond the fold line 25 to an edge 81 beyond the fold line 25 by a distance equal to that by which the edge 80 falls short of it. The sleeves 15 and 16 of the blank of FIG. 6 are shaped from the level 77 along lines 75 and 76 just as the sleeves of the blank of FIG. 5 are shaped.

To form a garment from the blank, the sleeves are folded about the line 25, the body is folded about the line 38 so that part 37 lies on top of part 12. The shoulder region 71 then lies on top of the shoulder region 48 and the edges 72 and 73 of the region 71 abut the inner edges of the sleeves 15 and 16. The edge 38 is then seamed to the edge 40, the under edges of the sleeves are seamed together and the inner edges of the sleeves are seamed to the edges 72 and 73. A desired neck line is cut out, a trimming is seamed around the neck opening (not shown) and any parts of the edges 80 and 81 remaining are seamed together to complete the garment.

Figure 7:
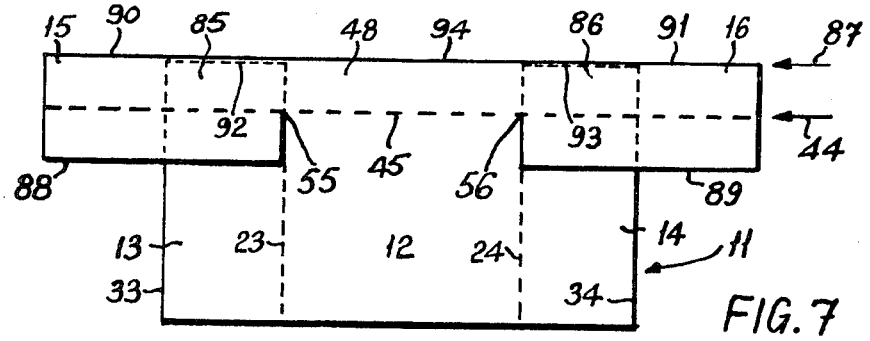
FIG. 7 is a schematic view of a garment blank showing a seventh mode of practicing the invention as applied to a set-on style garment.

A further garment blank according to the invention, in a set-on style, is shown in FIG. 7.

If knitting is started at the waist, it is continued to the arm pit level 44 where needles holding loops in the line 45, extending between the centres 55 and 56 of the arm pits of the blank, are taken out of knitting action but retain their loops. Knitting is continued to form the shoulder regions 85 and 86 which are extensions of front parts 13 and 14 of the garment body 11. The knitting of the regions 85 and 86 is continued to the level 87 which is the uppermost level of the neck in the garment. The loops of the last courses of these regions are then cast off and the knitting of the garment sleeves 15 and 16 is begun by casting on stitches on bare needles along the lines 88 and 89.

When the sleeves have been knitted as far as the level 44, the inactive needles holding loops in the line 45 are brought back into action and a course is knitted extending the whole length of the sleeve 15, the whole length of the line 45 and the whole length of the sleeve 16. Thereafter knitting of the sleeves 15 and 16 and a body shoulder region 48 is continued, the region 48 being located between the two sleeves and constituting an extension of the rear body part 12 so that wales are continuous between the part 12 and the shoulder region 48 whereas courses of knitting are continuous between the two sleeves through the region 48 and extend in the length directions of the sleeves. The region 48 thus forms a single piece of fabric with the sleeves 15 and 16.

When the knitting of the sleeves 15 and 16 and the region 48 also reaches the level 87, the blank is cast off from the needles.

To make a garment from the blank, the body front parts 13 and 14 are folded about lines 23 and 24 to lie on top of part 12. The sleeves are folded about a line at the level 44 through the arm pits, the lower halves of the sleeves in the Figure thus lying on top of the upper halves.

A suitable neck opening (not shown) is cut out of the shoulder regions 85 and 86. The edges 88 of sleeve 15 is seamed to edge 90 and the edge 89 of sleeve 16 is seamed to edge 91, the seams lying along the upper edges of the sleeves. The remaining parts of the edges 92 and 93 of regions 85 and 86 are seamed to the edge 94 of the region 48, and means for fastening together the edges 33 and 34 of the parts 13 and 14 are attached. If desired one of the parts 13 and 14 can be knitted so as to be larger than the other to provide an overlap.

Figure 8:
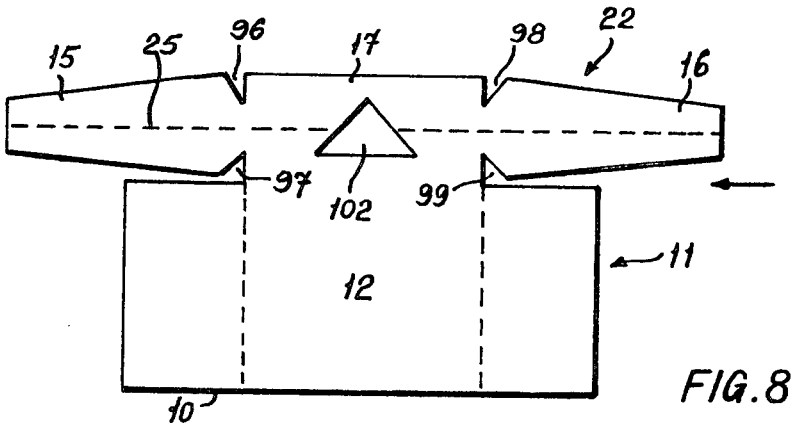
FIG. 8 is a schematic view of a garment blank showing an eighth mode of practicing the invention as applied to a garment in which the sleeves incline dowardly with respect to the body of the garment.

FIG. 8 illustrates a garment blank embodying an arrangement which ensures that the sleeves of the finished garment have a downward inclination in relation to the body. A neck opening is also formed in this blank so that the quantity of fabric which goes to waste in forming the final shape of the neck opening is reduced.

When knitting is started at the waste 10, the knitting of the body 11 of the blank of FIG. 8 follows the same procedure as that for the blank of FIG. 1 up the underarm level 44. The loops of the front body parts 13 and 14 are then cast off the needles and knitting is continued to form the sleeves 15 and 16 and the shoulder region 17 of the garment. The shoulder region 17 forms part of the same piece of fabric as the sleeves 15 and 16 and is knitted at the same time as the sleeves. The courses of sleeves extend along each sleeve and some of these courses extend into the shoulder region 17 which is located between the sleeves. The region 17 is an extension of and is integral with the body part 12 of the blank and wales are continuous between the part 12 and the region 17.

In order to cause the sleeves to have a downward inclination with respect to the body in the finished garment, triangular shaped apertures 96, 97, 98 and 99 are formed in the fabric 22 constituting the sleeves 15 and 16 and shoulder region 17 and extend into the fabric 22 from the longitudinal edges thereof. These apertures lie on the border lines between the sleeves and the region 17 and in the example of FIG. 8 extend solely into the sleeve fabrics although they may be caused to extend into the shoulder region 17 as well or solely into the region 17. The apertures 96 to 99 are formed by programming the needles of the knitting machine to a non-knitting condition over the region where an aperture is to be formed. Additional yarn carriers are required so that yarn for each sleeve and for the fabric of the region 17 can be supplied from a different yarn carrier when the apertures are being formed.

When the blank of FIG. 8 is folded for finishing, the sleeves 15 and 16 being folded about the line 25, the apertures 96 to 99 can be closed up and their opposite edges seamed together to secure the desired inclination of the sleeves to the body. The needles of the knitting machine can also be programmed to leave an aperture 102 in the shoulder region 17 in order to provide a basic neck opening for the garment. Again additional yarn carriers are required to supply yarns to knit the fabric on opposite sides of the aperture 102 and when the aperture 102 overlaps the apertures 96 to 99 still further carriers will be required.

In some cases the final shape of the neck opening can be produced on the knitting machine.

An aperture for a neck opening can also be formed in the garment blanks of FIGS. 1, 2 and 7 and apertures to cause downward inclination of the sleeves can be formed in the garment blanks of FIGS. 1 and 2 in the same way as in the garment blank of FIG. 8.

In all the garment blanks described, the sleeves and shoulder region of the garment blank are knitted on needles also used to knit body parts of the garment. All the garment blanks can be knitted by starting at the upper end in the Figures, knitting the sleeves and shoulder region first and finishing at the waist.

Figure 9:
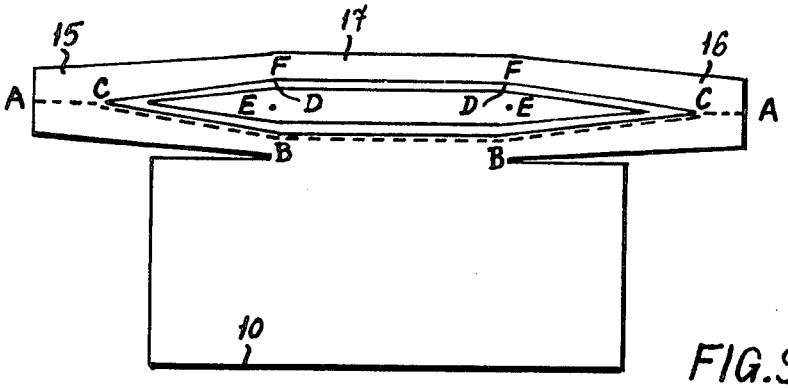
FIG. 9 is a schematic view of a garment blank showing a ninth mode of practicing the invention also applied to a garment in which the sleeves incline downwardly.

The garment blank of FIG. 9 has sleeves 15 and 16 which are caused to have a downward inclination in relation to the body in the finished garment by means of a technique employing courses of varying length in the sleeves 15 and 16 and shoulder region 17.

This can be done by two methods which will be described below in relation to a garment blank knitted starting at the waist 10.

In the first method, when the course A-A (shown as a broken line) is reached in the blank, all the needles are stopped but retain their loops. Knitting is then continued on needles holding loops in the section B-B of course A-A and in successive courses, additional needles are brought into action at both ends of the section B-B so that the courses progressively increase in length to C-C. Needles are then progressively taken out of action in an inwards direction from both ends of the bank of active needles until the course D-D is reached whereupon all the needles holding loops in the fabric between A and A are operated to knit and the sleeves and shoulder region are completed. The result is the formation of a pouch 105 over the shoulder region of the garment whereby wales of the shoulder region are longer in the central area thereof than in areas to each side.

Alternatively, the pouch may be formed by stopping knitting on the needles in sections A-C and C-A when the course A-A is reached. The next course knitted is C-B B-C and successive course thereafter are decreased in length from both ends of the bank of active needles until the course E-E is reached. A corresponding progressive increase in course length then takes place up to the course C-F F-C whereafter knitting is continued on all needles holding loops to complete the blank.

A neck opening (not shown) may be formed in this blank as illustrated in FIG. 8.

What is claimed is:

1. A method of knitting a blank for a sleeved garment, the method comprising the steps, in either order, of knitting a piece of fabric constituting the body of the garment having front and rear body parts with wales extending in the direction from waist to neck of the garment blank, and knitting another piece of fabric comprising sleeves for the garment with courses extending in the length direction of the sleeves, and also comprising a shoulder region of the garment located between the two sleeves with courses continuous between the sleeves and said shoulder region, said shoulder region being knitted as an extension of the body of the garment with wales continuous between the body and said shoulder region.

2. A method as claimed in claim 1, wherein said shoulder region comprises a number of courses equal to the maximum number of courses in the sleeve.

3. A method as claimed in claim 1, wherein said shoulder region comprises a smaller number of courses than the sleeves of the garment, the method including knitting a front or rear panel of the body of the garment having its wales continuous with said shoulder region, and knitting a panel or panels constituting the rear or front of the garment body and having an extension or extensions constituting a further shoulder region of the garment.

4. A method as claimed in claim 3, including shaping said further shoulder region to correspond with shaped sleeves of the blank so that when joined to the sleeves in the finished garment, the joins lie along Raglan style lines.

5. A method as claimed in claim 3, including shaping said further shoulder region to correspond with shaped sleeves of the blank so that when joined to the sleeves in the finished garment, the joins lie along style lines of a set-in style.

6. A method as claimed in claim 3, wherein said shoulder region is knitted contemporaneously with part of the fabric constituting the sleeves so that the course of the shoulder region most remote from the garment body in the blank is continuous with sleeve courses lying along the upper edges of the sleeves in the finished garment and located centrally in the sleeves along a line about which the sleeves are folded to form the garment.

7. A method as claimed in claim 3, wherein said shoulder region is knitted contemporaneously with part of the fabric constituting the sleeves so that the course of the shoulder region most remote from the body in the blank is continuous with sleeve courses lying along the upper edges of the sleeves in the finished garment but located along free edges of the sleeves in the blank.

8. A method as claimed in claim 1, wherein said shoulder region has a number of courses greater than half the number of courses in the sleeves but less than the full number and the method includes shaping the shoulder region to correspond with shaped sleeves so that when joined to the sleeves in the finished garment, the joins lie along style lines of a saddle shoulder style.

9. A method as claimed in claim 1, including forming apertures on the border lines dividing the sleeves from said first mentioned shoulder region, said apertures extending into the fabric of the sleeves and/or shoulder region from edges thereof, whereby when the fabric constituting the sleeves and shoulder region is folded to close said apertures, the sleeves of the blank are caused to assume a downward inclination in relation to the body.

10. A method as claimed in claim 1, including shaping said fabric comprising sleeves and said first mentioned shoulder region so that it contains a pouch causing the sleeves to incline downwardly in relation to the body in the finished garment.

11. A method as claimed in claim 10, wherein said pouch is formed by knitting courses of fabric of different length so that wales thereof in the control area of said shoulder region are longer than in areas of the fabric to each side of the central area, that is towards the ends of the sleeves.

12. A blank for a sleeved garment, the blank comprising a piece of fabric constituting the body of the garment and having front and rear body parts with wales extending in the direction from waist to neck of the garment blank, and another piece of fabric comprising sleeves for the garment with courses extending in the length direction of the sleeves, said other piece of fabric also comprising a shoulder region of the garment located between the two sleeves and with wales continuous between the sleeves and said shoulder region and said shoulder region constituting an extension of the body of the garment with wales which are continuous between the body and said shoulder region.

13. A blank as claimed in claim 12, wherein said shoulder region comprises a number of courses equal to the maximum number of courses in the sleeve.

14. A blank as claimed in claim 12, wherein said shoulder regin comprises a smaller number of courses than the sleeves of the garment, a front or rear panel of the body has its wales continuous with said shoulder region, and the blank includes a panel or panels constituting the rear or front of the garment body and having an extension or extensions constituting a further shoulder region of the garment.

15. A blank as claimed in claim 14, wherein said further shoulder region is shaped to correspond with shaped sleeves of the blank so that when joined to the sleeves in the finished garment, the joins lie along Raglan style lines.

16. A blank as claimed in claim 14, wherein said further shoulder region is shaped to correspond with shaped sleeves of the blank so that when joined to the sleeves in the finished garment the joins lie along style lines of a set-in style.

17. A blank as claimed in claim 14, wherein the course of said shoulder region most remote from the garment body in the blank is continuous with sleeve courses which lie along the upper edges of the sleeves in the finished garment and located centrally in the sleeves along a line about which the sleeves are folded to form the garment.

18. A blank as claimed in claim 14, wherein the course of said shoulder region most remote from the body in the blank is continuous with sleeve courses which lie along the upper edges of the sleeves but located along free edges of the sleeves in the blank.

19. A blank as claimed in claim 14, wherein said shoulder region has a number of courses greater than half the number of courses in the sleeves but less than the full number and the shoulder region is shaped to correspond with shaped sleeves so that when joined to the sleeves in the finished garment the joins lie along style lines of a saddle shoulder style.

20. A blank as claimed in claim 12, having apertures in the fabric constituting the sleeves and said first mentioned shoulder region, said apertures being located on the border lines dividing the sleeves from said shoulder region and extending into the fabric of the sleeves and/or shoulder region from the edges thereof, whereby when the fabric constituting the sleeves and said first mentioned shoulder region is folded to close said apertures, the sleeves of the blank are caused to have a downward inclination in a relation to the body.

21. A blank as claimed in claim 12, wherein the fabric constituting said sleeves and said first mentioned shoulder region is shaped so that it contains a pouch causing the sleeves to incline downwardly in relation to the body in the finished garment.

22. A blank as claimed in claim 21, wherein wales of the pouch in the central area of the fabric constituting said shoulder region and the sleeves are longer than in areas of the fabric to each side of said central area, that is towards the ends of the sleeves.

23. A method of knitting a blank for a sleeved garment, the method comprising the steps of:

(a) knitting a piece of fabric constituting two sleeves for the garment and a shoulder region for the garment between the two sleeves, knitted courses extending along one sleeve, through said shoulder region and along the other sleeve.

(b) continuing knitting from said shoulder region but forming knitted courses longer than said shoulder region to produce a piece of fabric constituting the body of the garment and having front and rear body parts, said body fabric being separated from said sleeves and knitted wales extending from said shoulder region into said body fabric.

24. A method of knitting a blank for a sleeved garment, the method comprising the steps of:

(a) knitting in the direction from the waist towards the neck, a piece of fabric constituting the body of the garment and having front and rear body parts, (b) continuing knitting to form a shoulder region of the garment continuous with said body so that wales extending between said body and said shoulder region (c) extending the length of the knitted courses whilst knitting said shoulder region to form on each side of said shoulder region a sleeve for said garment continuous with said shoulder region but separated from said garment body, courses of knitting extending along one sleeve, through said shoulder region and the other sleeve.

* * * * *

Disclaimer 4,102,155.—*Frank Robinson, Nigel Stephen Whatmough*, Breaston, England. KNITTING METHOD. Patent dated July 25, 1978. Disclaimer filed Dec. 3, 1979, by the assignee, *Courtaulds Limited.*

Hereby enters this disclaimer to claims 12 and 13 of said patent.

[*Official Gazette March 11, 1980.*]